US011774072B2

(12) United States Patent
Yang et al.

(10) Patent No.: US 11,774,072 B2
(45) Date of Patent: Oct. 3, 2023

(54) FIXING FRAME AND AUXILIARY DEVICE USING THE SAME

(71) Applicant: Qisda Corporation, Taoyuan (TW)

(72) Inventors: Ting-Ting Yang, Taoyuan (TW); Chih-Lung Huang, Taoyuan (TW)

(73) Assignee: Qisda Corporation, Taoyuan (TW)

( * ) Notice: Subject to any disclaimer, the term of this patent is extended or adjusted under 35 U.S.C. 154(b) by 0 days.

(21) Appl. No.: 17/680,450

(22) Filed: Feb. 25, 2022

(65) Prior Publication Data

US 2023/0021107 A1 Jan. 19, 2023

(30) Foreign Application Priority Data

Jul. 19, 2021 (TW) ..... 110126424

(51) Int. Cl.
*F21V 21/088* (2006.01)
*F21V 17/10* (2006.01)
*F21V 17/00* (2006.01)

(52) U.S. Cl.
CPC ..... *F21V 21/088* (2013.01); *F21V 17/002* (2013.01); *F21V 17/105* (2013.01)

(58) Field of Classification Search
CPC ..... F21V 33/0052; F21V 21/088; F21V 21/0885; F21V 21/34; F21V 21/116; F21V 21/096; F21V 21/0965; F21V 17/164; F21V 17/105; F21V 17/06; F21V 17/007; F21V 17/002; F21V 17/16; F21V 17/162; F21V 17/10; F21V 17/005; F16M 13/022; G06F 1/1686; G06F 1/1607; F21S 4/20; F21S 4/15; G09F 9/33; G09F 13/02
See application file for complete search history.

(56) References Cited

U.S. PATENT DOCUMENTS 3,723,720 A * 3/1973 Schmidt ..... F21S 9/02 362/183
5,322,255 A * 6/1994 Garrett ..... H04R 1/08 348/E7.079
5,790,910 A * 8/1998 Haskin ..... F16M 13/02 396/428
6,418,010 B1 * 7/2002 Sawyer ..... F16M 11/14 361/801
6,481,681 B1 * 11/2002 Stunkel ..... G06F 1/1601 248/229.11

(Continued)

FOREIGN PATENT DOCUMENTS

CN 112762384 A 5/2021
CN 213479775 U 6/2021

OTHER PUBLICATIONS

Office action of counterpart application by Taiwan IP Office dated Apr. 12, 2022.

*Primary Examiner* — Zheng Song
*Assistant Examiner* — James M Endo

(57) ABSTRACT

A fixing frame for a lamp is provided. The fixing frame is arranged on the lamp, and the lamp for being arranged on a display, and the display has a display surface. The fixing frame includes a first part and a second part. The first part matches the shape of lamp. The second part is connected with the first part to stand upright on the lamp, the second part has a first height in a longitudinal direction of the lamp, and a first surface of the second part is parallel to the display surface.

15 Claims, 9 Drawing Sheets

(56) References Cited

U.S. PATENT DOCUMENTS 6,679,463 B1 * 1/2004 Chen ..... F16M 13/00 396/428
6,731,340 B1 * 5/2004 Lai ..... H04N 5/2252 348/E5.026
6,738,094 B1 * 5/2004 Minami ..... H04N 7/142 348/E5.025
7,389,964 B2 * 6/2008 Ye ..... F16M 13/022 396/419
7,572,073 B2 * 8/2009 Kenoyer ..... F16M 13/022 396/428
8,240,862 B1 * 8/2012 Newhouse ..... F21V 33/0052 362/85
2003/0147206 A1 * 8/2003 Chen ..... F16M 11/14 361/679.55
2005/0151042 A1 * 7/2005 Watson ..... F16M 11/40 348/E7.079
2005/0247845 A1 * 11/2005 Li ..... F16M 11/14 248/346.5
2007/0001071 A1 * 1/2007 Yeh ..... F16M 11/14 248/179.1
2007/0212057 A1 * 9/2007 Liang ..... G03B 17/00 396/428
2008/0169408 A1 * 7/2008 Berman ..... G06F 1/1616 248/689
2008/0239141 A1 * 10/2008 Yang ..... F16M 13/022 348/E5.025
2009/0008521 A1 * 1/2009 Lee ..... F16M 13/00 248/226.11
2009/0146910 A1 * 6/2009 Gardner ..... G09F 9/3026 345/1.3
2009/0166483 A1 * 7/2009 Marsilio ..... F16M 11/041 248/187.1
2009/0310329 A1 * 12/2009 Brown ..... F21V 33/0052 362/18
2010/0039552 A1 * 2/2010 Kao ..... H04N 5/2252 348/373
2012/0120236 A1 * 5/2012 Xiao ..... H04N 5/2251 348/143
2013/0083517 A1 * 4/2013 Bratton ..... F21V 33/006 362/191
2014/0285993 A1 * 9/2014 Fisher ..... F21V 21/088 362/11
2015/0135998 A1 * 5/2015 Barsch ..... G06F 1/1607 108/42
2015/0144760 A1 * 5/2015 Paradiso ..... F16M 13/022 248/534
2015/0198865 A1 * 7/2015 Chang ..... G03B 17/561 396/428
2015/0301559 A1 * 10/2015 Wu ..... F16M 13/022 248/229.16
2016/0376809 A1 * 12/2016 McPeak ..... F21V 21/088 362/145
2017/0219915 A1 * 8/2017 Mueller ..... F21V 23/0407
2017/0261198 A1 * 9/2017 Shiell ..... H04N 5/2256
2018/0003338 A1 * 1/2018 Scott ..... A45F 5/00
2018/0221683 A1 * 8/2018 Kang ..... F21V 23/02
2018/0259167 A1 * 9/2018 Krieger ..... F21V 23/06
2018/0363889 A1 * 12/2018 Yen ..... F21V 21/088
2019/0346129 A1 * 11/2019 Yang ..... F21V 21/22
2019/0353343 A1 * 11/2019 Pan ..... F21V 21/26

* cited by examiner

FIXING FRAME AND AUXILIARY DEVICE USING THE SAME

This application claims the benefit of Taiwan application Serial No. 110126424, filed Jul. 19, 2021, the subject matter of which is incorporated herein by reference.

BACKGROUND OF THE INVENTION

Field of the Invention

The invention relates in general to a fixing frame, and more particularly to a fixing frame and an auxiliary device using the same.

Description of the Related Art

In response to the popular use of lamps and mounts on the market, mounts on screen, lamps, network cameras or other electronic devices can be placed onto or around the display, but currently installed separately, so users need to prepare different fixing frames to install these electronic devices. However, the space on top of the display is limited, and once an electronic device is installed, the space occupied by the electronic device cannot accommodate other electronic devices. Therefore, it is required to further improve in the use and space utilization of the fixing frame.

SUMMARY OF THE INVENTION

The present invention relates to a fixing frame and an auxiliary device using the same, for combining a fixing frame with a lamp, including detachable or non-detachable, so that both the fixing frame and the lamp can be located on the display in the same location to increase space utilization.

According to an aspect of the present invention, a fixing frame is provided for a lamp. The fixing frame is arranged on the lamp, including detachable or non-detachable, and the lamp for being arranged on a display, and the display has a display surface. The fixing frame includes a first part and a second part. The first part matches the shape of the lamp. The second part is connected to the first part and stands upright on the lamp, the second part has a first height in a longitudinal direction of the lamp, and a first surface of the second part is parallel to the display surface.

According to an aspect of the present invention, an auxiliary device is provided, which for being arranged on a display, the display has a display surface, and the auxiliary device includes a lamp and a fixing frame. The lamp could be detachably arranged on the display. The fixing frame is arranged on the lamp, including detachable or non-detachable. The fixing frame includes a first part and a second part. The first part is integrated with the outer surface of the lamp. The second part is connected to the first part and stands upright on the lamp, the second part has a first height in a longitudinal direction of the lamp, and a first surface of the second part is parallel to the display surface.

According to an aspect of the present invention, an auxiliary device is provided, which is for arranged on a display, and the auxiliary device includes a lamp and a fixing frame. The lamp could be detachably arranged on the display. The fixing frame is arranged on the lamp, including detachable or non-detachable, wherein at least one of the fixing frame and the lamp includes a magnetic element for magnetically connecting the fixing frame and the lamp.

The above summary is not intended to represent each embodiment or every aspect of the present invention. Rather, the foregoing summary provides only examples of some of the novel aspects and features set forth herein. The above-described features, as well as advantages and other features of the present disclosure, will become more apparent from the following detailed description of representative embodiments and modes for carrying out the invention when taken in conjunction with the accompanying drawings and the appended claims.

Other objects, features, and advantages of the invention will become apparent from the following detailed description of the preferred but non-limiting embodiments. The following description is made with reference to the accompanying drawings.

DETAILED DESCRIPTION OF THE INVENTION

First Embodiment

Figure 1A:
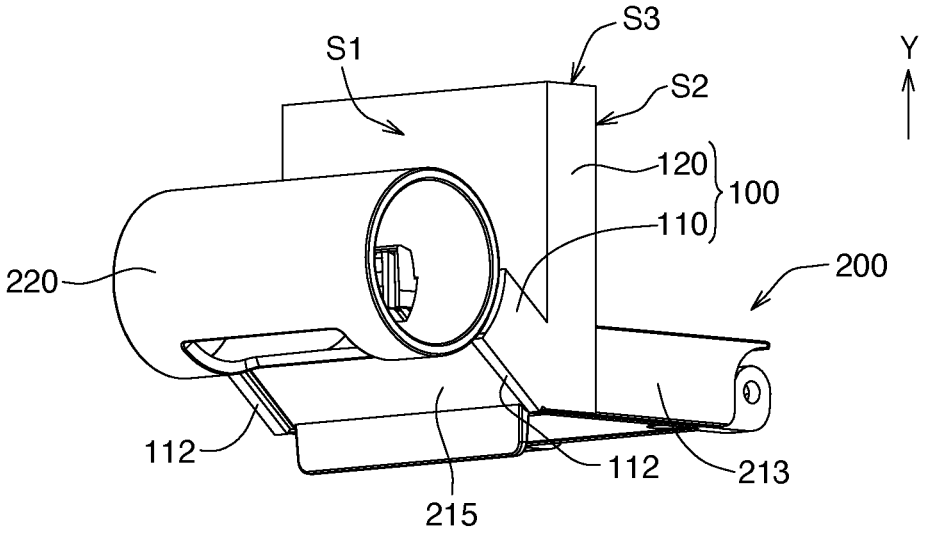
FIG. 1A is a schematic diagram illustrating a combination of a fixing frame and a lamp according to an embodiment of the present invention.
Figure 1B:
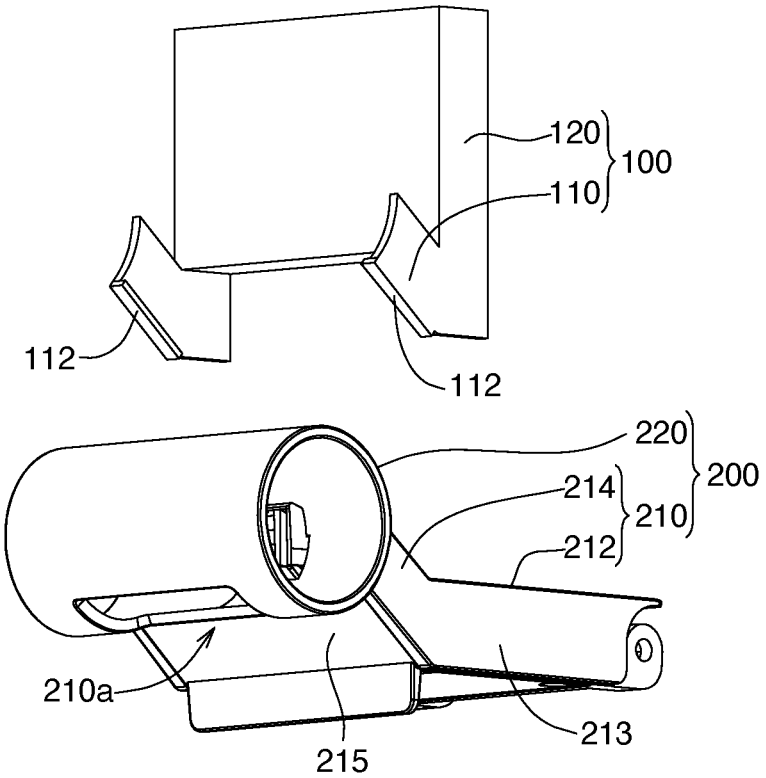
FIG. 1B is an exploded schematic view of the fixing frame and the lamp of FIG. 1A.

FIG. 1A is a schematic diagram illustrating a combination of a fixing frame 100 and a lamp 200 according to an embodiment of the present invention, and FIG. 1B is an exploded schematic view of the fixing frame 100 and the lamp 200 in FIG. 1A.

Please refer to FIGS. 1A and 1B, the fixing frame 100 includes a first part 110 and a second part 120. The first part 110 matches the shape of the lamp 200 and is combined with the outer surface of the lamp 200. The second part 120 is a three-dimensional object similar to a square, for example, and the second part 120 stands upright on the lamp 200. That is to say, the first part 110 is connected to the bottom of the second part 120, the second part 120 is erected on the lamp 200 by the combination of the first part 110 and the lamp 200, and the combination of the first part 110 and the lamp 200 includes a detachable or non-detachable.

In one embodiment, the first part 110 and the second part 120 are integrally formed with, for example, plastic (or iron), so that the first part 110 is fixedly connected to the bottom of the second part 120. In addition, the first part 110 can extend obliquely with respect to the longitudinal direction Y of the second part 120 to form a V shape or horizontally extend to form an L shape, so that the shape of the first part 110 can match the shape of the lamp 200 and be compatible with the lamp. 200, the combination of the first part 110 and the lamp 200 can be detachable or non-detachable.

As shown in FIGS. 1A and 1B, the lamp 200 may include a lampshade 220 and an upper part 210. The lampshade 220 is disposed on a first connecting end 210*a* of the upper part 210, so that the lampshade 220 generally protrudes from the upper surface 211 of the upper part 210 and has an accommodating space inside for arranging a light source. The upper part 210 has, for example, a horizontal support part 212 and an upward extension part 214. The upward extension part 214 is integrally connected between the lamp 200 and the horizontal support part 212, so that the lampshade 220 substantially protrudes out of the horizontal support part 212.

In order for the fixing frame 100 to be arranged on the lamp 200, the fixing frame 100 may be arranged at any position of the lamp 200. In one embodiment, in order for the fixing frame 100 to be arranged on the upper part 210 of the lamp 200, the fixing frame 100 can be detachable or non-detachable. The upper part 210 has a side surface 213 and a lower surface 215, the lower surface 215 is connected between two side surfaces 213, and the first part 110 matches the shape of the side surface 213 of the upper part 210, and is combined with the two side surfaces 213 of the upper part 210. As shown in FIG. 1B, the first part 110 includes, for example, a fastener 112. The fastener 112 extends horizontally inward from the bottom of the first part 110 and is parallel to each other to form a hook portion. When the first part 110 is installed downward from the top of the upper part 210, the first part 110 can be slightly opened to be located on the outer side of the side surface 213 of the upper part 210, and then the fastener 112 can be used from the side surface 213 of the upper part 210 to clamp the upper member 210, so that the fastener 112 is rebound and fastened to the lower surface 215 of the upper member 210, and the installation as shown in FIG. 1A is completed.

The installed first part 110 is combined with the upper part 210, and the second part 120 can stand upright on the upper part 210, and the second part 120 has a first height H1 (e.g., the height of the third surface S3, see FIG. 5) as an auxiliary structure of the lamp 200.

Figure 5:
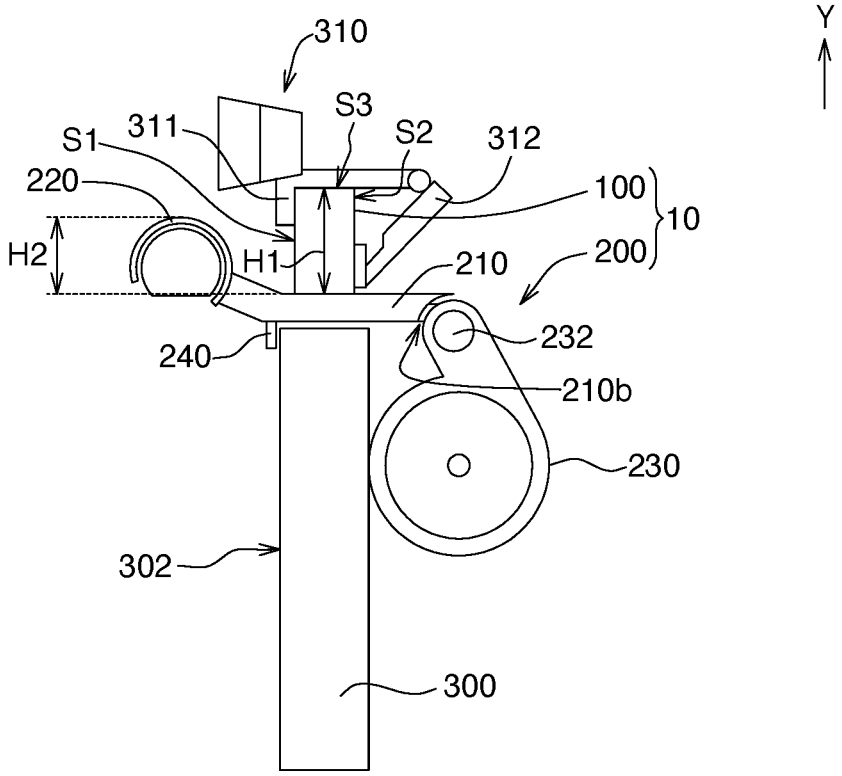
FIG. 5 is a schematic diagram illustrating a combination of a fixing frame, a lamp and a display according to an embodiment of the present invention.

For example, in FIG. 5, the lamp 200 is disposed on a display 300, and the upper part 210 of the lamp 200 is located above the display 300. The fixing frame 100 can be arranged at any position of the lamp 200, including being arranged on the lampshade 220, the upper part 210 and/or the lower part 230. The lamp 200 can provide an illumination in front of the display 300, and the fixing frame 100 is erected on the lamp 200 to serve as a fixing frame for installing an external device 310. The external device 310 is, for example, a network camera. The network camera can be hung on the fixing frame 100, so that the lens of the network camera can at least be exposed on top of the lampshade 220 of the lamp 200. The external device 310 can also be a computer peripheral device such as a small network transmission interface, a Wi-Fi connector, an antenna module or a battery module, which is not limited by the present invention.

In addition, in FIG. 5, the display 300 has a display surface 302, and in FIG. 1A, the second part 120 has a first surface S1, a second surface S2 and a third surface S3. The surface S1 is opposite to the second surface S2 and is substantially parallel to the display surface 302. In addition, the third surface S3 is connected to the first surface S1 and the second surface S2 and is located on the top of the second part 120. The height H3 of the third surface S3 is, for example, higher than the height H2 of the lampshade 220, so as to serve as the fixing frame 100 of the camera. However, the present invention is not limited thereto. If the height H3 of the third surface S3 is not limited, the height H3 of the third surface S3 can also be less than or equal to the height H2 of the lampshade 220.

Second Embodiment

Figure 2A:
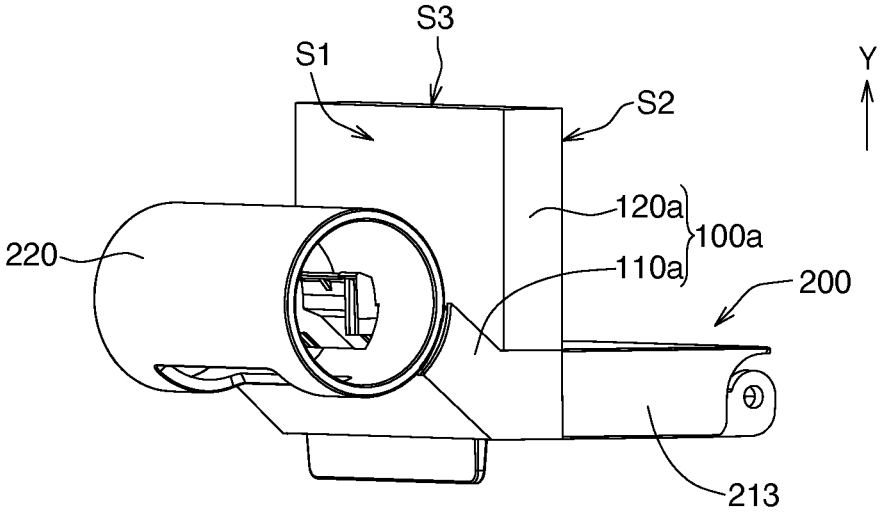
FIG. 2A is a schematic diagram illustrating a combination of a fixing frame and a lamp according to another embodiment of the present invention.
Figure 2B:
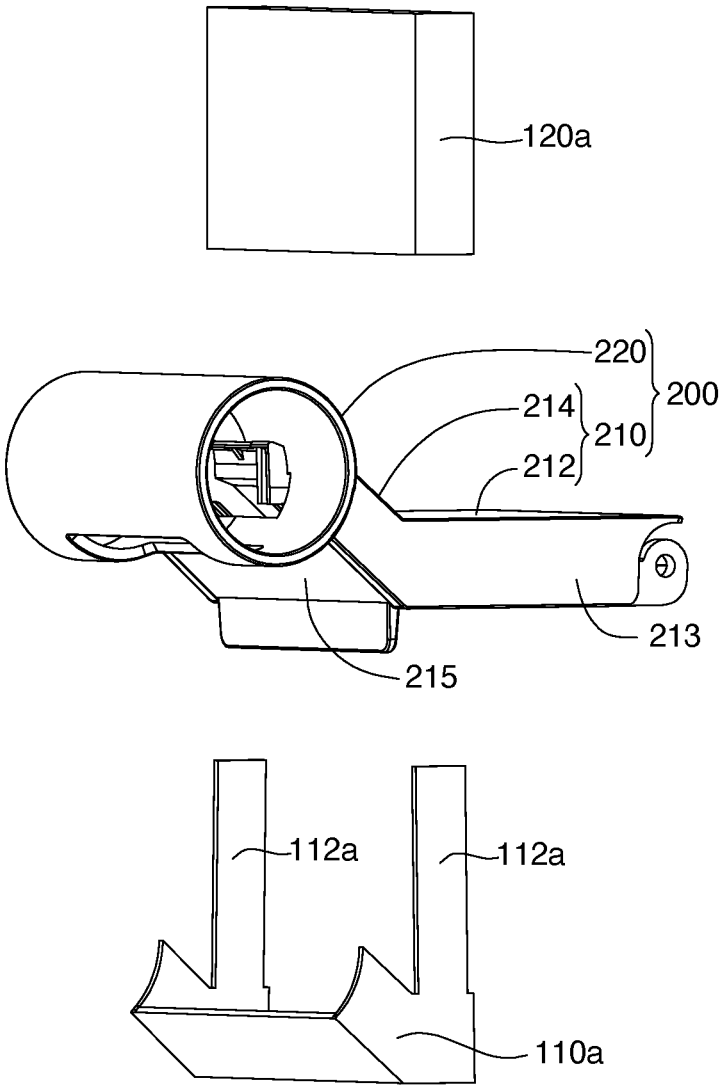
FIG. 2B is an exploded schematic view of the fixing frame and the lamp of FIG. 2A.

FIG. 2A is a schematic diagram illustrating a combination of the fixing frame 100*a* and the lamp 200 according to another embodiment of the present invention, and FIG. 2B is an exploded schematic view of the fixing frame 100*a* and the lamp 200 of FIG. 2A. Please refer to FIGS. 2A and 2B, the description of the lamp 200 is basically the same as that of the first embodiment, and will not be repeated here. The difference is that the fixing frame 100*a* of this embodiment includes a first part 110*a* and a second part 120*a* separate from the first part 110*a*. The first part 110*a* can be installed upward from the lower surface 215 of the lamp 200, and the second part 120*a* can be installed downward from the upper surface 211 of the lamp 200. The first part 110*a* can be combined with the second part 120*a* disposed on the upper surface 211 of the lamp 200 from the lower surface 215 of the lamp 200, so that the first part 110*a* and the second part 120*a* can clamp the lamp 200.

In an embodiment, in order for the fixing frame 100*a* to be clamped to the upper part 210 of the lamp 200, the upper part 210 has a lower surface 215, the lower surface 215 is connected between two side surfaces 213, and the first part 110*a* matches the shape of the lower surface 215 of the upper part 210 (e.g., U-shape), and is clamped with the upper part 210. As shown in FIG. 2B, the first part 110*a* includes, for example, a rod 112*a* extending upward from the side surface 213 of the upper part 210. When the first part 110*a* is installed upward from the bottom of the upper part 210, the second part 120*a*, installed downward from the upper surface 211 of the upper part 210, is engaged with the rod 112*a*, so that the first part 110*a* and the second part 112*a* are engaged and clamp the lamp 200. In the embodiment, when the rods 112*a* are plural, they can also be slightly opened and located outside the two side surfaces 213 of the upper part 210, the second part 120*a* installed downward from the upper surface 211 of the upper part 210 is engaged with the rods 112*a*, so that the first part 110*a* and the second part 120*a* clamp the lamp 200, and the installation as shown in FIG. 2A is completed.

The installed first part 110*a* is combined with the upper part 210, and the second part 120 can stand upright on the upper part 210, and the second part 120*a* has a first height H1 in the longitudinal direction Y of the lamp 200, as an auxiliary structure of the lamp 200. The second part 120*a* is, for example, a square three-dimensional object. The two rods 112*a* of the first part 110*a* can be inserted into the second part 120*a* from the bottom of the second part 120*a* to clamp the lamp 200.

As described in the first embodiment, the fixing frame 100*a* can be used as a fixing frame for installing a camera, and the height of the second part 120*a* relative to the upper part 210 (i.e., the height H1 of the third surface S3) is, for example, higher than the height H2 of the lampshade 220, so that the camera is exposed on top of the lamp 200, as shown in FIG. 5, but the present invention is not limited thereto. If the height of the second part 120*a* is not limited, the height H1 of the second part 120*a* can also be less than or equal to the height H2 of the lampshade 220.

Third Embodiment

Figure 3A:
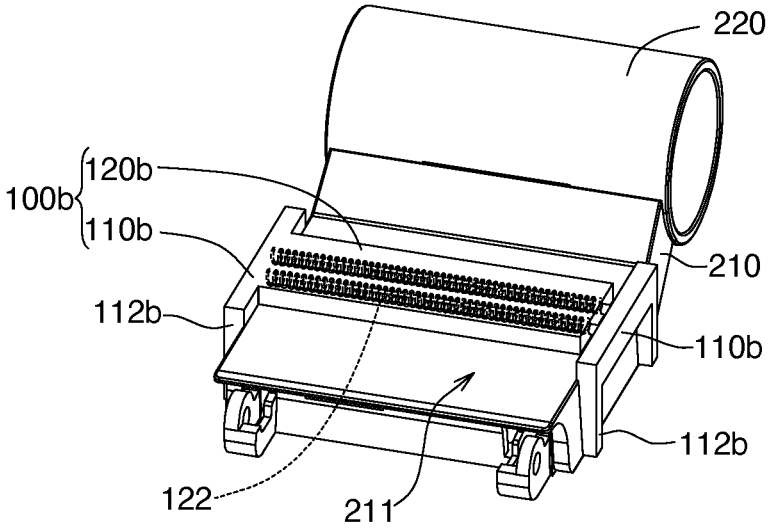
FIG. 3A is a schematic diagram illustrating a combination of a fixing frame and a lamp according to another embodiment of the present invention.
Figure 3B:
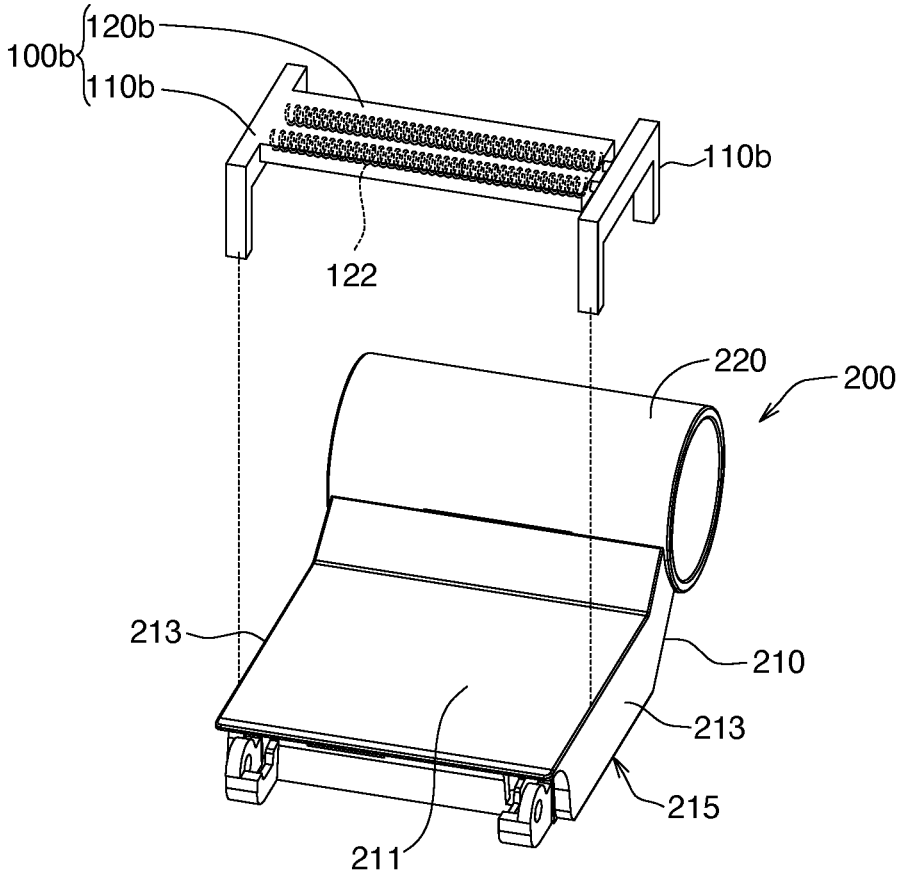
FIG. 3B is an exploded schematic view of the fixing frame and the lamp of FIG. 3A.

FIG. 3A is a schematic diagram illustrating a combination of the fixing frame 100*b* and the lamp 200 according to another embodiment of the present invention, and FIG. 3B is an exploded schematic view of the fixing frame 100*b* and the lamp 200 in FIG. 3A. Please refer to FIGS. 3A and 3B. The description of the lamp 200 is basically the same as that of the first and second embodiments, and will not be repeated here. The difference is that the fixing frame 100*b* of this embodiment includes a first part 110*b* and a second part 120*b* connected with each other by an elastic member 122, so that the first part 110*b* can elastically clamp the lamp 200.

In one embodiment, in order for the fixing frame 100*b* to be clamped to the upper part 210 of the lamp 200, the upper part 210 has a side surface 213 and an upper surface 211, and the upper surface 211 is connected to the side surface 213, and the first part 110*b* matches the shape of the side surface 213 of the upper part 210 and is combined with the side surface 213 of the upper part 210. In addition, the second part 120*b* spans the upper surface 211 of the upper part 210, and the second part 120*b* includes at least one elastic member 122, which is elastically connected to the first part 110*b*, so that the first part 110*b* can clamp the upper part 210*b*. The elastic member 122 is, for example, a tension spring, which is disposed in the second member 120*b* and can be stretched by force to generate a resilient force, so that the first member 110*b* can clamp the upper member 210 stably.

As shown in FIG. 3B, the first part 110*b* includes, for example, two fasteners 112*b*, and the two fasteners 112*b* are parallel to each other. When the first part 110*b* is installed downward from the top of the upper part 210, the first part 110*b* can be slightly opened to be located on the outside of the side surface 213 of the upper part 210, and then the two fasteners 112*b* can be installed from outer side of the side surface 213 of the upper part 210 to clamp the upper member 210, so that the two fasteners 112*b* are fastened to the upper member 210 through the elastic member 122, and the installation as shown in FIG. 3A is completed. Although this embodiment does not show that the two fasteners 112*b* have the hook portion as described in the first embodiment, but using a similar hook structure, the two fasteners 112*b* of this embodiment can also be rebounded through the elastic member 122 and fastened to the lower surface 215 of the upper part 210. The description is not shown here.

Figure 3C:
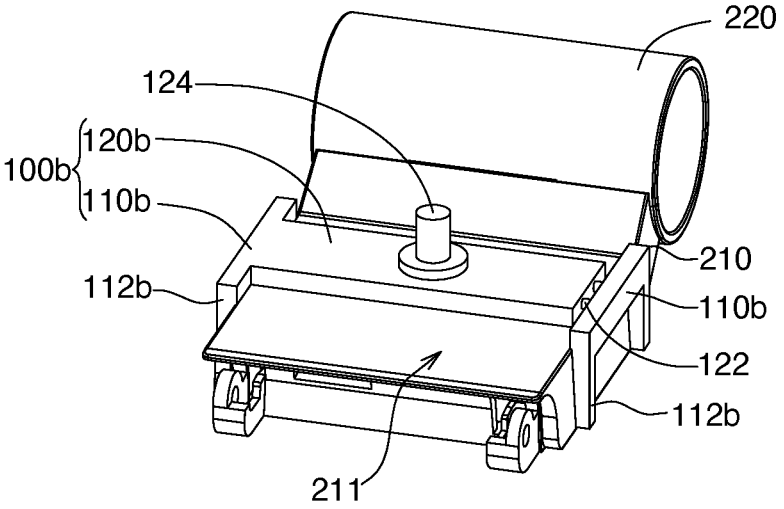
FIG. 3C is a schematic diagram illustrating a combination of a fixing frame and a lamp according to another embodiment.

In FIG. 3A, the installed first part 110*b* is combined with the upper part 210, and the second part 120*b* can be arranged horizontally to form a platform. The height of the platform is not limited, and it can be used to install an external device 310. In addition, as shown in FIG. 3C, the second part 120*b* may further include a post or a male connector 124, which protrudes from the second part 120*b*, so that an external device 310 can be directly disposed on the second part 120 through the post or the male connector 124. In one embodiment, the post or the male connector 124 can be a standard screw dedicated to the camera, which can fix the camera on the second part 120*b*.

Figure 3D:
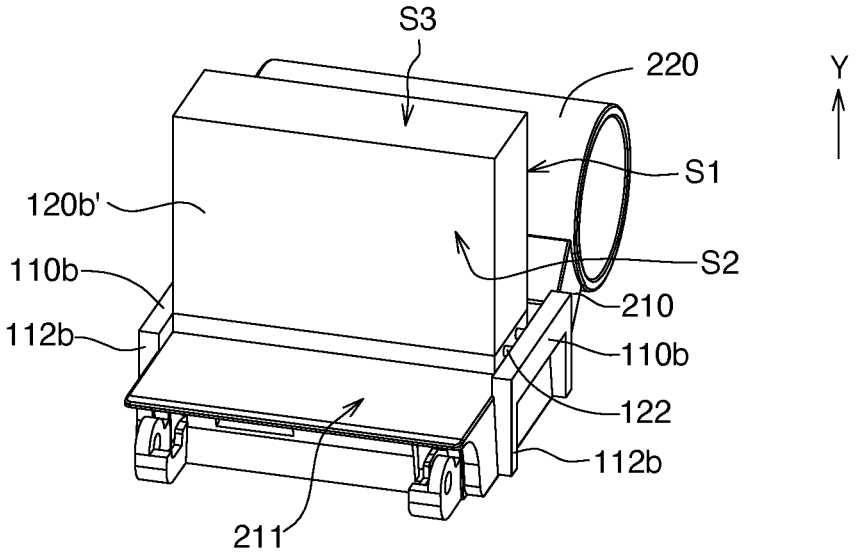
FIG. 3D is a schematic diagram illustrating a combination of a fixing frame and a lamp according to another embodiment.

Referring to FIG. 3D, in another embodiment, the second part 120*b*' can also have a three-dimensional object as described in the first and second embodiments, which protrudes from the upper part 210 to form a three-dimensional object used as an auxiliary structure of the lamp 200.

As described in the first and second embodiments, the second part 120*b*' can be used as a fixing frame for installing a camera, and the height of the second part 120*b*' relative to the upper part 210 (i.e., the height H1 of the third surface S3) is, for example, higher than the top height H2 of the lampshade 220, so that the camera is exposed on the top of the lamp 200, as shown in FIG. 5, but the present invention is not limited thereto. If the height of the second part 120*b*' is not limited, the height of the second part 120*b*' can also be less than or equal to the height H2 of the lampshade 220.

Fourth Embodiment

Figure 4A:
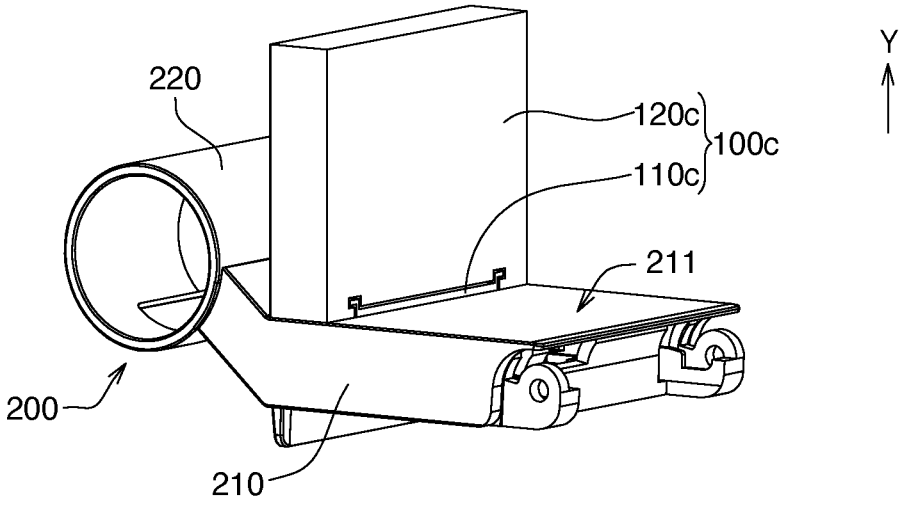
FIG. 4A is a schematic diagram illustrating a combination of a fixing frame and a lamp according to another embodiment of the present invention.
Figure 4B:
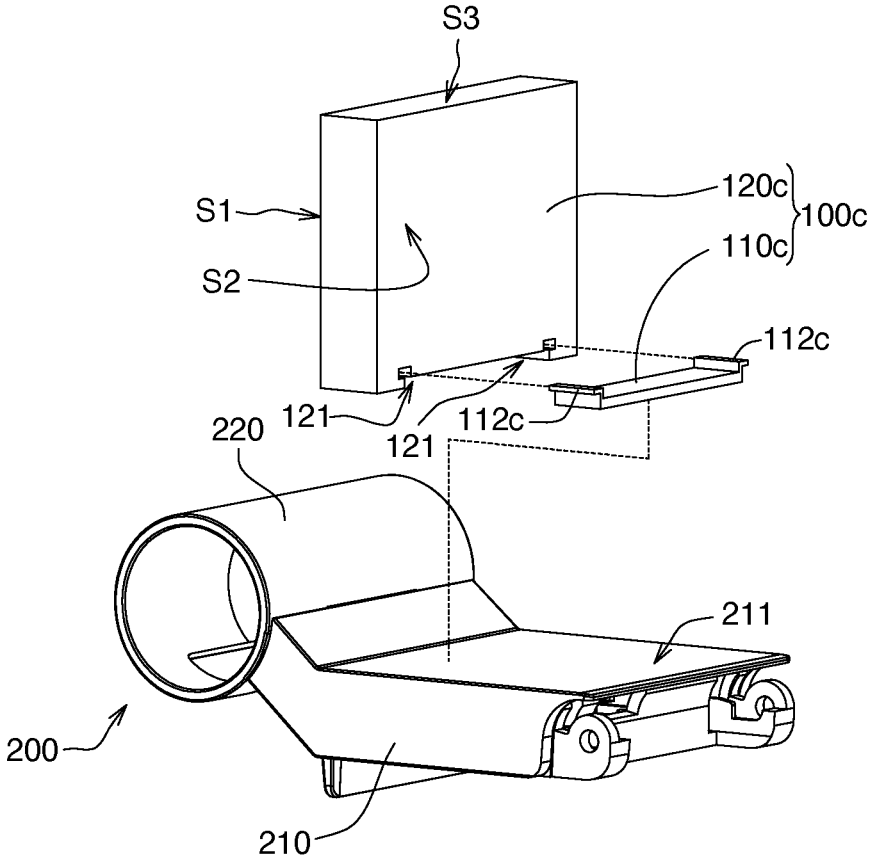
FIG. 4B is an exploded schematic view of the fixing frame and the lamp of FIG. 4A.

FIG. 4A is a schematic diagram illustrating a combination of the fixing frame 100*c* and the lamp 200 according to another embodiment of the present invention, and FIG. 4B is an exploded schematic view of the fixing frame 100*c* and the lamp 200 of FIG. 4A. Please refer to FIGS. 4A and 4B. The description about the lamp 200 is basically the same as that of the first, second, and third embodiments, and will not be repeated here. The difference is that the fixing frame 100*c* of this embodiment includes a first part 110*c* and a second part 120*c* attracted to each other by a magnet, so that the second part 120*c* can stand upright on the lamp 200.

In one embodiment, the first part 110*c* matches the shape of the upper surface 211 of the upper part 210 and is combined with the upper surface 211 of the upper part 210. For example, the first part 110*c* is fixed to any part of the lamp 200 by adhesive (or screw), for example, to the upper surface 211 of the upper part 210, and at least one of the first part 110*c* and the second part 120*c* includes a magnetic element, the first part 110*c* and the second part 120*c* can be a metal part that can be magnetically attracted (for example, iron), or the first part 110*c* is a metal part that can be magnetically attracted (such as iron), and the second part 120*c* includes a magnetic element, or both the first part 110*c* and the second part 120*c* include a magnetic element. Through magnetic attraction, the second part 120*c* can be erected on the lamp 200.

In one embodiment, the bottom of the second part 120*c*, for example, is provided with a slot 121, and the first part 110 is correspondingly provided with at least one clip 112*c*, and the slot 121 matches the shape of the clip 112*c* so as to connect the second part 120*c* with the first part 110*c*.

The installed first part 110*c* is combined with the upper part 210, and the second part 120*c* can stand upright on the upper part 210, and the second part 120*c* has a first height H1 in the longitudinal direction Y of the lamp 200, as an auxiliary structure of the lamp 200. In addition, the height of the second part 120*c* relative to the upper part 210 (i.e., the height H1 of the third surface S3) is, for example, higher than the height H2 of the lampshade 220, so that the camera is exposed on the top of the lamp 200, as shown in FIG. 5, but the present invention is not limited thereto. If the height of the second part 120*c* is not limited, the height of the second part 120*c* can also be less than or equal to the height H2 of the lampshade 220.

In another variant embodiment, if the lamp 200 includes a magnetic element, for example, the upper part 210 includes a magnetic element, and the entire fixing frame 100*c* is a metal member (e.g., iron) that can be magnetically attracted, or the lamp 200 includes a magnetically attractable metal part (e.g., iron), for example, the upper part 210 is a magnetically attracted metal, and the fixing frame 100*c* includes a magnetic element. For example, both the upper part 210 and the fixing frame 100*c* include a magnetic element, or the upper part 210 and the fixing part 110*c* include a magnetic element, so that the fixing frame 100*c* can be magnetically connected to the lamp 200 without using the first part 110*c* to be fixed on the upper part 210.

In addition, referring to FIG. 5, a schematic diagram of the combination of the fixing frame 100, the lamp 200 and the display 300 according to an embodiment of the present invention is shown. In this embodiment, the fixing frame 100 is combined with the lamp 200 to form an auxiliary device 10, which is disposed on the display 300. For the description of the fixing frame 100 and the lamp 200, reference may be made to the above-mentioned embodiments, and not repeated here. In addition, the lamp 200 may further include a lower part 230, such as a counterweight block, the lower part 230 can be pivotally connected to a second connecting end 210*b* of the upper part 210 through a rotating shaft 232, and can provide a counterweight to the display 300, so that the lamp 200 can be stably suspended on the display 300 through its own counterweight, which is not limited in the present invention. In addition, the lamp 200 may further include a stopper 240, for example, the stopper 240 is disposed on the front edge of the horizontal support portion 212 and abuts against the side surface of the display 300, so that the upper part 210 can be supported on the display 300 by the holding structure formed by the stopper 240 and the lower part 230, which is not limited in the present invention. In addition, the external device 310 can be hung on the third surface S3 of the fixing frame 100, and the two legs 311 and 312 are respectively abutted on the opposite first surface S1 and the second surface S2, so that the external device 310 can be supported on the fixing frame 100 by the holding structure formed by the two legs 311 and 312. However, the external device 310 can also be fixed on the fixing frame 100 in other ways, which is not limited in the present invention.

The fixing frame and the auxiliary device using the same of the above-mentioned embodiment of the present invention are configured to be arranged on a computer peripheral device, such as a display, but not limited thereto. In each of the above-mentioned embodiments, the fixing frame can be fixed on the lamp by means of buckling, clamping, elastic parts and magnetic attraction, etc., so that the fixing frame can be detachably fixed on the lamp as an auxiliary structure for installing an accessory. Therefore, the present invention is utility.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A fixing frame for a lamp, the fixing frame being arranged on the lamp, the lamp for being arranged on a display, and the display having a display surface, wherein the fixing frame comprises:

a first part combined with an outer surface of the lamp;

a second part connected to the first part and stands upright on the lamp, the second part has a first height in a longitudinal direction of the lamp, and a first surface of the second part is parallel to the display surface, wherein the fixing frame is arranged to detachably clamp an upper part of the lamp, wherein the lamp comprises a lampshade arranged on a first connection end of the upper part, the upper part has a side surface, the first part matches a shape of the side surface of the upper part and is combined with the side surface of the upper part.

2. The fixing frame according to claim 1, wherein the first part comprises a fastener, and the fastener is fastened to the upper part from the side surface of the upper part.

3. The fixing frame according to claim 1, wherein the upper part has a lower surface, wherein, the first part matches a shape of the lower surface of the upper part, and the first part includes a rod extending upwardly from the upper part, wherein the lamp comprises an upper surface and the lower surface opposite to the upper surface, the first part is combined with the second part arranged on the upper surface from the lower surface, so that the first part and the second part clamp the lamp.

4. The fixing frame according to claim 1, wherein the second part comprises at least one elastic part elastically connected to the first part, so that the first part clamps the upper part.

5. The fixing frame according to claim 4, wherein the first part comprises two fasteners, the two fasteners are opposite to each other and the upper part is clamped by the two fasteners from the side surface of the upper part.

6. The fixing frame according to claim 4, wherein the second part further comprises a post or a male connector protruding from the second part.

7. The fixing frame according to claim 4, wherein the first part and the second part form a three-dimensional object, and the three-dimensional object has the first height in the longitudinal direction.

8. A fixing frame for a lamp, the fixing frame being arranged on the lamp, the lamp for being arranged on a display, and the display having a display surface, wherein the fixing frame comprises:

a first part combined with an outer surface of the lamp;

a second part connected to the first part and stands upright on the lamp, the second part has a first height in a longitudinal direction of the lamp, and a first surface of the second part is parallel to the display surface, wherein the fixing frame is detachably disposed on an upper part of the lamp, wherein the lamp comprises a lampshade arranged at a first connection end of the upper part, and the upper part has an upper surface, wherein, the first part matches a shape of the upper surface of the upper part, and is combined with the upper surface of the upper part, at least one of the first part and the second part comprises a magnetic element magnetically connected to the first part and the second part, so that the second part stands upright on the upper part.

9. An auxiliary device for being arranged on a display, the display having a display surface, the auxiliary device comprising:

a lamp detachably disposed on the display;

a fixing frame arranged to detachably clamp an upper part of the lamp, and the fixing frame comprising:

a first part combined with an outer surface of the lamp;

a second part connected to the first part and stands upright on the lamp, the second part has a first height in a longitudinal direction of the lamp, and a first surface of the second part is parallel to the display surface, wherein the lamp comprises a lampshade arranged on a first connection end of the upper part, the upper part has a side surface, the first part matches a shape of the side surface of the upper part and is combined with the side surface of the upper part.

10. The auxiliary device according to claim 9, wherein the first part comprises a fastener, and the fastener is fastened to the upper part from the outer surface of the upper part.

11. The auxiliary device according to claim 9, wherein the lamp comprises a lampshade arranged at a first connection end of the upper part, and the upper part has a lower surface, wherein, the first part matches a shape of the lower surface of the upper part, and the first part comprises a rod extending upwardly from the upper part, wherein the lamp comprises an upper surface and the lower surface opposite to the upper surface, the first part is combined with the second part arranged on the upper surface from the lower surface, so that the first part and the second part clamp the lamp.

12. The auxiliary device according to claim 9, wherein the second part comprises at least one elastic part elastically connected to the first part, so that the first part clamps the upper part.

13. The auxiliary device according to claim 12, wherein the first part comprises two fasteners, the two fasteners are opposed to each other and the upper part is clamped by the two fasteners from the side surface of the upper part.

14. The auxiliary device according to claim 12, wherein the first part and the second part form a three-dimensional object, and the three-dimensional object has the first height in the longitudinal direction.

15. An auxiliary device for being arranged on a display, the display having a display surface, the auxiliary device comprising:

a lamp detachably disposed on the display;

a fixing frame detachably arranged on an upper part of the lamp, and the fixing frame comprising:

a first part combined with an outer surface of the lamp;

a second part connected to the first part and stands upright on the lamp, the second part has a first height in a longitudinal direction of the lamp, and a first surface of the second part is parallel to the display surface, wherein the lamp comprises a lampshade arranged on a first connection end of the upper part, and the upper part has an upper surface, wherein, the first part matches a shape of the upper surface of the upper part, and is combined with the upper surface of the upper part, at least one of the first part and the second part includes a magnetic element magnetically connected to the first part and the second part, so that the second part stands upright on the upper part.

* * * * *